US006880431B2

(12) United States Patent
Wakabayashi et al.

(10) Patent No.: US 6,880,431 B2
(45) Date of Patent: Apr. 19, 2005

(54) PNEUMATICALLY OPERATED SCREW DRIVER HAVING DRIVE BIT ATTACHING AND DETACHING MECHANISM

(75) Inventors: Michio Wakabayashi, Hitachinaka (JP); Akira Uno, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 10/356,927

(22) Filed: Feb. 4, 2003

(65) Prior Publication Data

US 2003/0154824 A1 Aug. 21, 2003

(30) Foreign Application Priority Data

Feb. 15, 2002 (JP) ..... P2002-37779

(51) Int. Cl.[7] ..... B25B 13/00

(52) U.S. Cl. ..... 81/57.44; 81/57.37; 81/54; 173/93.5

(58) Field of Search ..... 81/57.44, 57.37, 81/54, 430, 433, 435, 434; 173/93.5, 220, 157, 159

(56) References Cited

U.S. PATENT DOCUMENTS 6,026,713 A * 2/2000 Ohmori et al. ..... 81/57.44

6,647,836 B1 * 11/2003 Habermehl ..... 81/434

* cited by examiner

*Primary Examiner*—Joseph J. Hail, III
*Assistant Examiner*—Alvin J Grant
(74) *Attorney, Agent, or Firm*—Sughrue Mion, PLLC

(57) ABSTRACT

A pneumatically operated screw driver driven by a compressed air to drive screws into a workpiece. A drive bit connecting portion is rotated in a right-hand direction by rotation of a pneumatic motor and is formed with a right-handed threaded hole. A drive bit is formed at one end with a right-handed male threaded screw and at the other end with an engagement tip that engages with screws that are to be screwed into the workpiece. The drive bit is engaged with the drive bit connecting portion through threading engagement of the right-handed threaded hole and the righted-handed male threaded screw. For detaching the drive bit from the drive bit connecting portion, a rotation prevention mechanism prevents free rotation of the drive bit connecting portion. In this state, the engagement tip of the drive bit is engaged with an external tool. By rotating the external tool in a counterclockwise direction while preventing the rotation of a main body of the screw driver, the drive bit is disengaged from the drive bit connecting portion.

9 Claims, 6 Drawing Sheets

9
10
54
51
1
4
7
53
5
55
23
8
22
24
14
11
56
52
12
28
20
26
15
28A
28a
57
16A
30
21
13
58
17
F
70
16
19
W
18

PNEUMATICALLY OPERATED SCREW DRIVER HAVING DRIVE BIT ATTACHING AND DETACHING MECHANISM

BACKGROUND OF THE INVENTION

The present invention relates to a pneumatically operated screw driver preferably used for screwing a threaded fastening member to a woody material or the like. More particularly, the invention relates to the screw driver provided with a mechanism for attaching and detaching a drive bit.

Various pneumatically operated screw drivers have been conventionally proposed. According to a typical arrangement of the pneumatically operated screw drivers, a drive bit is rotated by an pneumatic motor to screw a threaded fastening member. For example, U.S. Pat. No. 6,026,713 discloses a screw driver including an pneumatic motor in which a rotor is rotatable in response to the pressure of pressurized air. A cylindrical rotary member is connected to the pneumatic motor for causing a rotation in synchronism with the rotation of the rotor. A rotary slider is slidable in the axial direction along the inner cylindrical wall of the rotary member. A rotational force transmitting mechanism is provided for transmitting the rotation of the rotary member to the rotary slider. A shaft has one end fixed to the rotary slider and the other end equipped with a piston and a drive bit holder. A rotational and axial motion of the rotary slider is transmitted to a drive bit held in the drive bit holder. A cylinder guides the axial slide movement of the piston responsive to the pressure of pressurized air applied on a pressure-receiving surface of the piston.

As shown in FIG. 9, a piston 313 integrally provides a drive bit holder 313A in which a hexagonal hole 313*a* is formed. An upper end of a drive bit 316 is formed with a hexagonal shaft 316A that is fitted in the hexagonal hole 313*a*. This connection links rotation of the drive bit 316 and the piston 313 so that the drive bit 316 does not rotate idly with respect to the piston 313. Further, the hexagonal shaft 316A is formed with an annular bit groove 307, and a plurality of holes are formed in the bit holder 313A for receiving therein balls 304. A biasing ring 305 is provided around the bit holder 313A for pressing the balls 304 radially inwardly toward the axial center of the hexagonal shaft 316A. Thus, each ball 304 is engaged with the annular bit groove 307. This prevents the drive bit 316 from pulling out from the bit holder 313A.

Because the pneumatically operated screw driver presses the drive bit 316 down against a screw 18 while rotating the drive bit 316, the tip end of the drive bit 316 that directly connects the screw 18 can be frequently damaged by friction. The drive bit 316 needs to be replaced each time it is damaged.

To replace the drive bit 316, the drive bit 316 is pulled out from the piston 313, and a new drive bit 316 is then inserted in its place. However, before performing this bit changing operation, the user must first undo attachment bolts (not shown) from a casing 301 to remove a nose 370. Then, the user grasps the tip of the drive bit 316 using a tool, such as a pair of pliers, and pulls the drive bit 316 off the piston 313 so as to forcibly displace the balls 304 from the annular bit groove 307. Next, the user inserts the new drive bit 316 and reattaches the nose 370 to the casing 301.

However, these operations for replacing the drive bit 316 are complicated, troublesome, and time-consuming. The disassembling operations of removing the attachment bolts and the nose 370 are not only troublesome, but can allow dirt and dust to enter into the area around a cylinder 315 while the nose 370 is removed. This dirt and dust can become the cause of break downs.

Sometimes during use of the screw driver, the tip of the drive bit 316 can slightly fuse to the cruciform hole in the head of the screw 18. As a result, the drive bit 316 tends to cling to the screw 18. Since the drive bit 316 is supported on the piston 313 merely by urging force of the biasing ring 305 against the balls 304. Therefore, if the drive bit 316 clings to the screw 18, then the drive bit 316 can pull off the piston 313 when the piston 313 returns to its initial position. To avoid this problem, the biasing force of the biasing ring 305 can be increased so that the drive bit 316 does not pull off so easily. However, this is not a desirable solution because the drive bit 316 would be harder to pull off when the drive bit 316 needs to be replaced.

SUMMARY OF THE INVENTION

It is an object of the present invention to overcome the above-described problems and provide a pneumatically operated screw driver wherein the drive bit is securely fixed to the rotation shaft, but easy to replace.

This and other objects of the present invention are attained by a pneumatically operated screw driver that operates with a compressed air to drive screws into a workpiece, the screw driver including a casing, an accumulator chamber portion, a pneumatic motor, a rotation transmitting portion, a rotator, a drive bit connecting portion, a main valve, an operation valve, and a drive bit. The accumulator chamber portion is provided in the casing for defining an accumulator chamber that accumulates the compressed air. The pneumatic motor is rotatable by the compressed air from the accumulator chamber in one direction only. The rotation transmission portion includes a rotary member that transmits rotation of the pneumatic motor. The rotator is rotated only in a right-hand direction by the rotation transmitted by the rotation transmission portion. The rotator includes a rotation slide member and a piston. The rotation slide member is supported in the rotary member so as to rotate together with the rotation of the rotary member and so as to be movable in an axial direction of the rotary member. The piston is connected to the rotation slide member and is rotatable together with the rotation of the rotary slide member and movable in the axial direction. The drive bit connecting portion is formed with one of a right-handed female threaded hole and a righted-handed male threaded screw. The main valve is adapted for controlling supply of the compressed air in the accumulator chamber to the pneumatic motor and the rotary member. The operation valve is adapted for controlling the main valve and is accessible from an external position. The drive bit is formed at one end with one of the right-handed male thread screw and a female threaded hole and at the other end with an engagement tip engagable with the screws that are to be screwed into the workpiece. The drive bit is threadingly engaged with the drive bit connecting portion through threading engagement of the right-handed female threaded hole and the righted-handed male threaded screw. The rotation of one of the pneumatic motor, the rotary member and the rotator is regulatable during non-application of the compressed air into the pneumatic motor, while the engagement tip at the other end of the drive bit being engaged with a first tool.

DETAILED DESCRIPTION OF THE PREFERRED EMBODIMENTS

Figure 1:
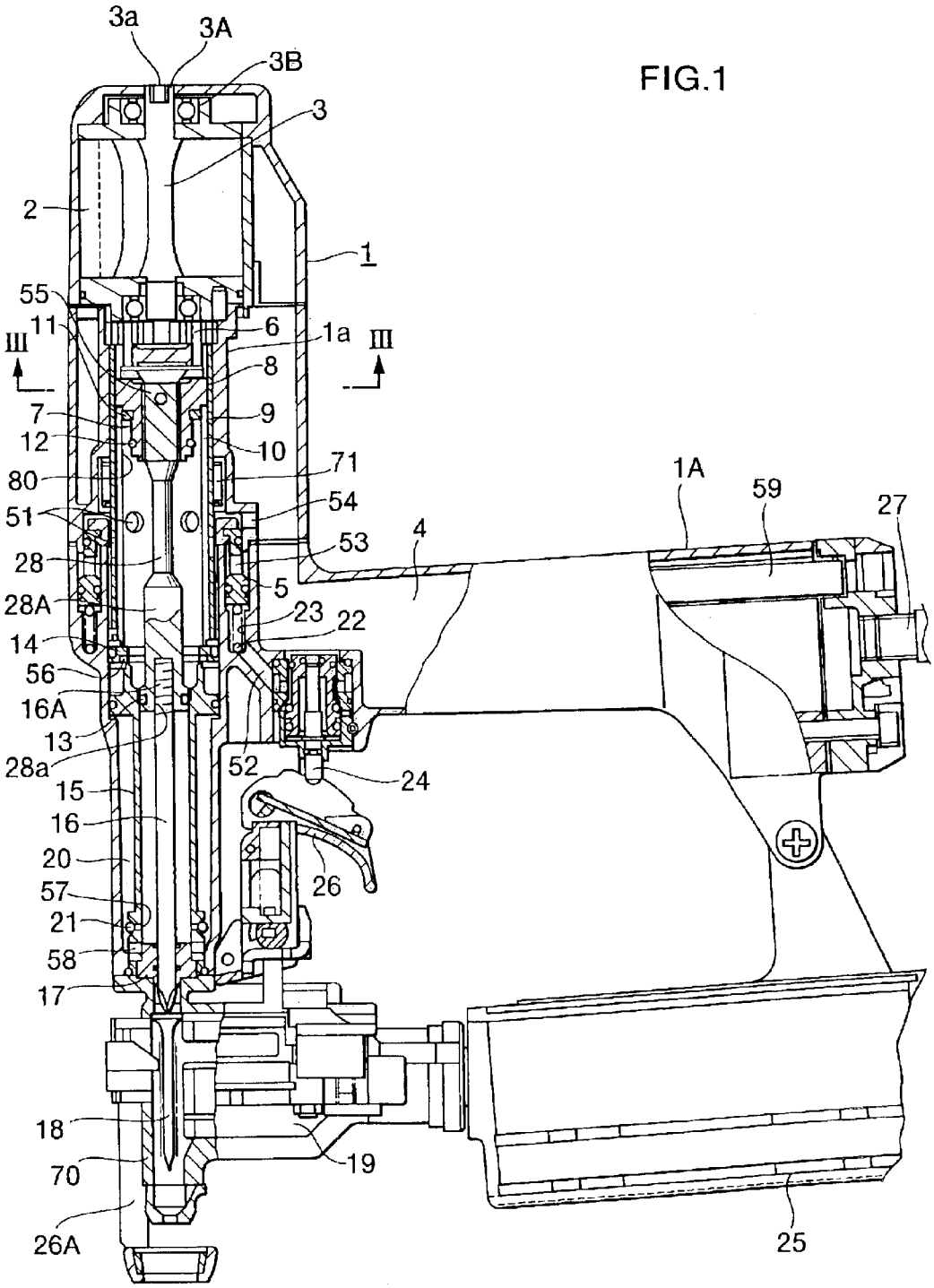
FIG. 1 is a cross-sectional view showing an overall arrangement of a pneumatically operated screw driver according to a first embodiment of the present invention.

A pneumatically operated screw driver according to a first embodiment of the present invention will be described with reference to FIGS. 1 through 4.

The screw driver includes a casing 1 that forms the external frame of the device. The casing 1 includes a handle 1A which the user grips when using the device. The handle 1A is formed with a compressed-air intake port 27 for connecting to a compressor (not shown). An accumulator chamber 4 and an exhaust channel 59 are enclosed substantially in the handle 1A. The accumulator chamber 4 is in fluid communication with the intake port 27. A trigger 26 that the user squeezes to drive an operation valve 24 is provided near a base end of the handle 1A.

The upper end portion of the casing 1 houses an pneumatic motor 2, a planetary gear unit 6, and a rotation 20 transmission portion 80. The pneumatic motor 2 includes a rotatably supported rotor 3. The rotor 3 engages with the planetary gear unit 6 to transmit the speed-reduced rotation to a rotary member 9 of the rotation transmission portion 80.

The rotary member 9 causes a clockwise rotation in synchronism with the rotation of the rotor 3. The rotation transmission portion 80 also includes a rotation slide member 7.

Figure 3:
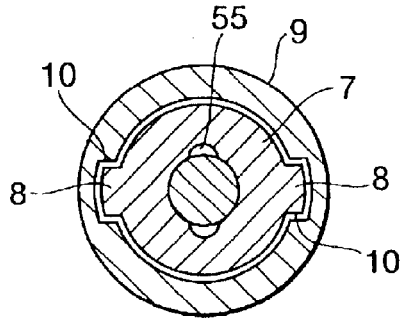
FIG. 3 is a cross-sectional view taken along line III—III of FIG. 1.

The rotary member 9 has the shape of a hollow cylinder with a bottom wall portion and is formed with a pair of grooves 10 and through holes 51. The pair of grooves 10 are formed in the inner peripheral surface of the rotary member 9 and extend in the axial direction of the rotary member 9. The rotation slide member 7 is inserted in the rotary member 9 and includes protruding ribs 8 that fit into the grooves 10 of the rotary member 9 as shown in FIG. 3. With this configuration, the rotation slide member 7 rotates in clockwise direction in conjunction with the rotary member 9 but can slide vertically with respect to the rotary member 9. That is, the rotary slider 7 is slidable in the axial direction without causing a relative rotation with respect to the rotary member 9.

The lower end portion of the casing 1 houses a piston portion 13 and a fixed cylinder 15. The piston portion 13 is connected to a lower end of the rotation slide member 7 and is vertically slidably supported in the cylinder 15, which is fixed to the casing 1. The rotation slide member 7 and the piston 13 are referred to collectively as a rotator. The piston portion 13 has sealing around its outer periphery to form a sealed condition between the piston portion 13 and the cylinder 15. A drive bit 16 is detachably connected to the piston portion 13.

A magazine 25, a screw feeder 19, and a nose 70 are connected to the lower end of the casing 1. The magazine 25 is connected to the free end of the handle 1A and houses a bundle of screws (not shown). The screw feeder 19 automatically supplies one screw 18 at a time from the bundle of screws (not shown) in the magazine 25 The nose 70 is connected to the lower end of the casing 1 by attachment bolts (not shown). The nose 70 guides downward movement of the drive bit 16 and movement of screws 18 to a screwing position beneath the drive bit 16. A push lever 26A is provided below the screw feeder 19. The push lever 26A is linked to the operation valve 24. The operation valve 24 is prevented from operating unless the push lever 26A is_pressed against a workpiece W.

When the screw 18 is to be screwed into a workpiece W, air pressure in the accumulator chamber 4 is supplied to the pneumatic motor 2 to rotate the pneumatic motor 2 clockwise (right-handed rotation). The rotator and consequently the drive bit 16 are rotated by rotation of the pneumatic motor 2. At this time, air pressure is also supplied to the upper surface of the piston portion 13. The piston portion 13 and consequently the drive bit 16 move downward as a result.

The rotary member 9 is rotatably supported via a needle bearing 71 by a cylindrical inside wall 1*a* of the casing 1 extending in the up-and-down direction. The rotary body 9 has a plurality of the ventilation holes 51 provided at the axial center thereof. The inside wall 1*a* of the casing 1 has a cylindrical groove 23 extending in the up-and-down direction at a portion facing to the holes 51. The groove 23 accommodates a cylindrical main valve 5 with an associated spring 22. The spring 22 urges the main valve 5 upward. The main valve 5 is slidable along the cylindrical groove 23. The clearance between the main valve 5 and the groove 23 is sealed at the upper and lower ends of the cylindrical side wall of the main valve 5. The main valve 5 has a ventilation hole 53 at an axial center thereof.

The lower end of the groove 23 communicates with the manual operating valve 24 via a passage 52 extending obliquely downward. The upper end of the groove 23 communicates with the accumulator chamber 4 via a passage 54.

The rotary slider 7 has an air shut face 11 and is equipped with an O-ring 12 on its outer cylindrical surface. A shaft 28 has an upper end connected to the rotary slider 7.

The shaft 28 has an enlarged lower portion serving as a drive bit connecting portion 28A where a female right hand thread hole 28*a* is formed. The drive bit 16 has a top end portion formed with a right-hand male thread 16A theadingly engageable with the female right hand thread hole 28*a* of the drive bit connecting portion 28A. The drive bit 16 extends coaxially with the shaft 28 upon connection.

The lowermost end portion of the enlarged lower portion of the shaft 28 serves as the piston 13. A seal ring 30 (FIG. 2) is provided on an outer cylindrical surface of the piston 13. With this seal ring 30, the piston 13 is hermetically coupled with the inside wall of a cylinder 15. The piston 13 is slidable in the axial direction along the inside wall of the cylinder 15.

A ventilation passage 55 extends across the rotary slider 7 from the upper surface to the lower surface along the gap between the rotary slider 7 and the shaft 28. A damper plate 14 is positioned above the cylinder 15. The damper plate 14 is brought into contact with the air shut face 11 of the rotary slider 7 when the rotary slider 7 reaches the dead end of its lowering stroke. A ventilation hole 56 opens at a lower portion of the damper plate 14. The hole 56 communicates with an air inlet (not shown) of the pneumatic motor 2 via an air passage (not shown).

A piston damper 17 is attached to the lower end of the fixed cylinder 15. Two ventilation holes 57 and 58 open at the lower end of the cylinder 15. The upper hole 57 serves as a pressurized air outlet while the lower hole 58 serves as a pressurized air inlet. The upper pressurized air outlet 57 is axially offset from the lower pressurized air inlet 58. The piston 13 moves downward during an axial screwing stroke of the drive bit 16. When the shut face 11 of the rotary slider 7 hits the damper plate 14, the piston 13 is stopped at the dead end of the axial screwing stroke of the drive bit 16. At this moment, the upper pressurized air outlet 57 is positioned above the seal ring 30 and the lower pressurized air inlet 58 is positioned below the seal ring 30.

An O-ring 21, acting as a one-way valve, is provided outside the hole 57. A cylindrical space defined by the outer wall of the cylinder 15 and an inner wall of the casing 1 serves as a returning accumulator chamber 20 whose arrangement is well known in a conventional pneumatically operated nailing machine.

In operation, the pressurized air is introduced into the accumulator chamber 4 when the pressurized air intake port 27 is connected to the compressor (not shown). Part of the pressurized air flows into the groove 23 via a pressure supply path (not shown) in the manual operating valve 24 and the passage 52. Thus, the lower surface of the main valve 5 receives the pressure of pressurized air. The main valve 5 is moved upward by a composite force of the pressurized air and the spring 22. When the main valve 5 reaches the uppermost position, the upper end of the main valve 5 closes the communication passage 54 connecting the accumulator chamber 4 and the holes 51 of the rotary member 9. Upon closure of this communication passage 54, no pressurized air is supplied to the piston 13 and the pneumatic motor 2.

Figure 2:
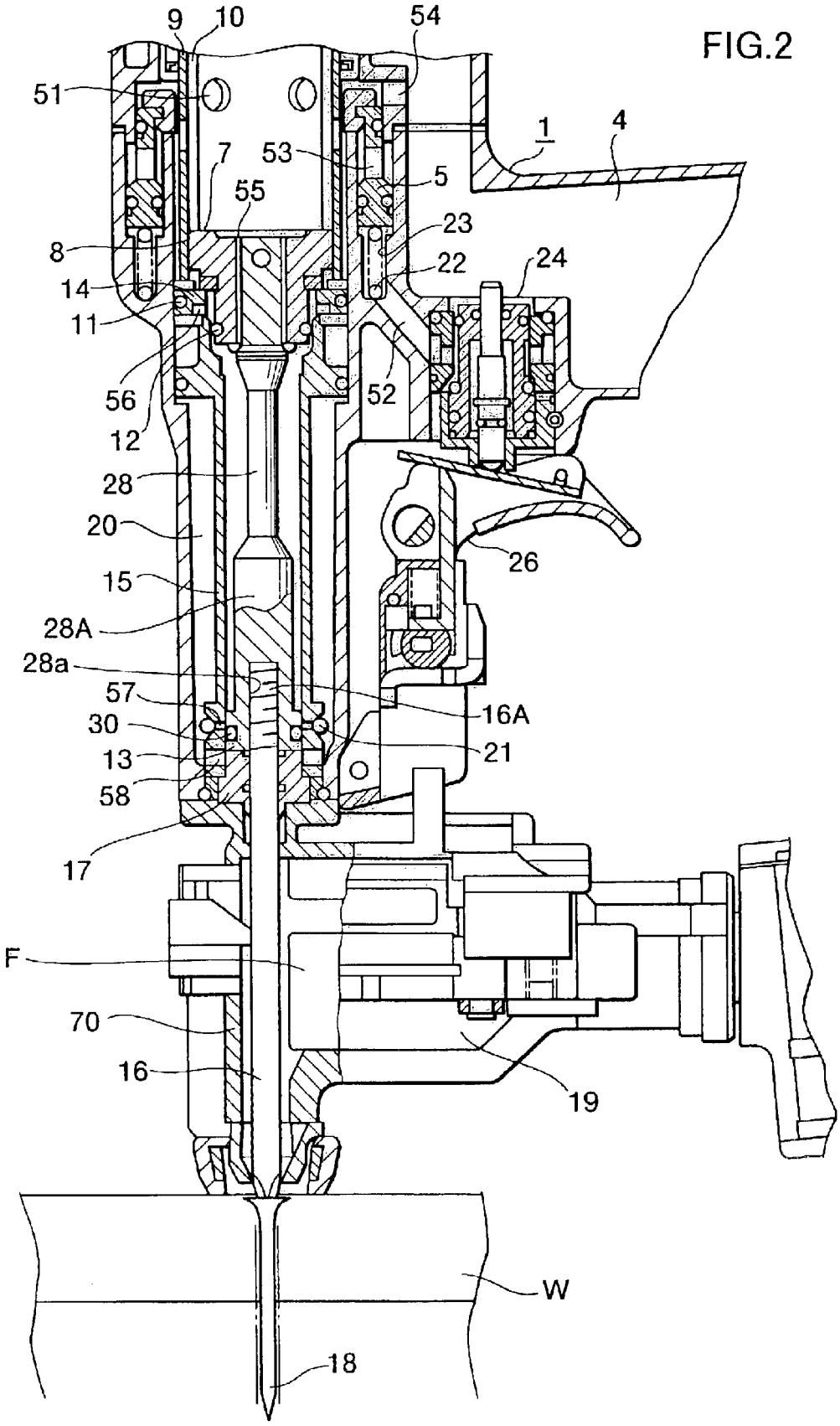
FIG. 2 is a cross-sectional side view showing an operational condition of the pneumatically operated screw driver of FIG. 1.

When a user manipulates the trigger lever 26, the manual operating valve 24 shifts upward to discharge or drain the pressurized air residing in the groove 23 via the passage 52 and a pressure relief path (not shown) in the manual operating valve 24. At this moment, the top surface of the main valve 5 receives the downward force exceeding the biasing force of the spring 22. This downward force is given by the pressurized air supplied from the accumulator chamber 4 via the passage 54. Thus, the main valve 5 moves downward against the spring force of the spring 22 as shown in FIG. 2.

The lower shift movement of the main valve 5 opens the communication passage 54 connecting the accumulation chamber 4 and the holes 51 of the rotary member 9. Thus, the pressurized air flows into the inside space of the rotary member 9 via the passage 54 and the holes 51 from the accumulator chamber 4.

The upper surface of piston 13 receives the pressure from the pressurized air in the rotary member 9. Being pressed by the pressurized air, the piston 13 moves downward. Further, the pneumatic motor 2 communicates with the inside space of the rotary member 9 via the hole 56. Therefore, the pressurized air is introduced into the pneumatic motor 2 from this hole 56. The rotor 3 of the pneumatic motor 2 rotates in response to the pressure of the supplied air. The rotation of the rotor 3 is transmitted via the planetary gear unit 6 to the rotary member 9 and the rotary slider 7. The rotary slider 7 rotates together with the rotary member 9 without causing a relative rotation.

Because the rotary slider 7 is connected with the shaft 28 and the piston 13 is integral with the shaft 28, the rotation of the rotary slider 7 in the clockwise direction is transmitted to the piston 13, while the piston 13 moves downward. The drive bit 16 is connected to the drive bit connecting portion 28A of the shaft 28 which is integral with the piston 13. Thus, the drive bit 16 rotates in the clockwise direction and moves downward together with the piton 13.

In response to the rotational and axial downward movement of the drive bit 16, the screw 18 held in the nose 70 is removed off the connecting band and screwed into the workpiece W.

When the drive bit 16 reaches the lowermost end (i.e., the dead end of the axial screwing stroke as shown in FIG. 2), the air shut face 11 of the rotary slider 7 is brought into contact with the damper plate 14. Thus, the piston 13 is stopped. Further, the O-ring 12 provided on the outer surface of the rotary slider 7 seals the upper end of the inner cylindrical wall of the cylinder 15. The air shut face 11 closes the hole 56. Upon closing the hole 56, no pressurized air flows into the pneumatic motor 2. The rotor 3 in the pneumatic motor 2 rapidly decreases its speed and stops completely. As a result, all of the planetary gear unit 6, the rotary member 9, the rotary slider 7, the piston 13 and the drive bit 16 decelerate and stop.

In this condition, the pressurized air in the accumulator chamber 4 flows into the returning accumulator chamber 20 from the accumulator chamber 4 via the passage 54, the holes 51, the upper chamber of the rotary slider 7, the passage 55, the pressurized air outlet 57 and the O-ring, i.e., the one-way valve 21. Furthermore, the pressurized air inlet 58 allows the pressurized air acting on the lower surface of the piston 13.

When the lower surface of the piston 13 is brought into contact with the upper surface of the piston damper 17, the lower surface of the piston 13 has a pressure-receiving area smaller than, that of the upper surface of the piston 13. Thus, the piston 13 firmly contacts with the piston damper 17 due to a pressure difference between the upper and lower surfaces of the piston 13.

FIG. 2 shows the piston 13 positioned at the lowermost end immediately after the seal ring 30 of the piston 13 passed the hole 57. Before the seal ring 30 passes the hole 57, no pressurized air flows into the returning accumulator chamber 20 and no pressure of the pressurized air acts on the lower surface of the piston 13. A large pressure difference is caused between the upper and lower surfaces of the piston 13. Thus, the piston 13 is strongly pressed by this large pressure difference.

When the user returns or releases the manual operating valve 24, the pressurized air of the accumulator chamber 4 flows into the groove 23 via the pressure supply path (not shown) in the manual operating valve 24 and the passage 52. The lower surface of the main valve 5 receives the supplied pressurized air, and the main valve 5 moves upward. When the main valve 5 reaches the uppermost position, the upper end of the main valve 5 closes the communication passage 54 connecting the accumulator chamber 4 and the holes 51 of the rotary member 9. Upon closure of the communication passage 54 by the main valve 5, no pressurized air is supplied to the piston 13 and the pneumatic motor 2. At this moment, the hole 53 formed at the axial center of the main valve 5 communicates with the discharge passage 59 via a passage (not shown) so as to establish a pressurized air drain path.

On the other hand, the O-ring (i.e., the one-way valve) 21 closes the hole 57. In other words, the O-ring 21 prevents the pressurized air remaining in the returning accumulator chamber 20 from flowing into the cylinder 15 via the hole 57. Thus, a significant amount of air pressure still acts on the lower surface of the piston 13 through the lower hole 58. By receiving this air pressure, the piston 13 moves upward to the uppermost position. Thus, the drive bit 16 returns to its original or home position shown in FIG. 1. At the same time, the screw feeder 19 feeds the next screw 18 to the screwing position of the drive bit 16. Next, configuration for attaching the drive bit 16 to and detaching the drive bit 16 from the piston 13 will be described. As described above, the drive bit connecting portion 28A is provided between the drive bit 16 and the piston 13, and the right handed female thread hole 28*a* is formed in the connecting portion 28A and at the axial center of the piston 13. Further, the top end portion of the drive bit 16 is formed with the right-handed male thread 16A threadingly engageable with the female thread hole 28*a* upon clockwise rotation of the drive bit 16 with respect to the drive bit connecting portion 28A.

Figure 4:
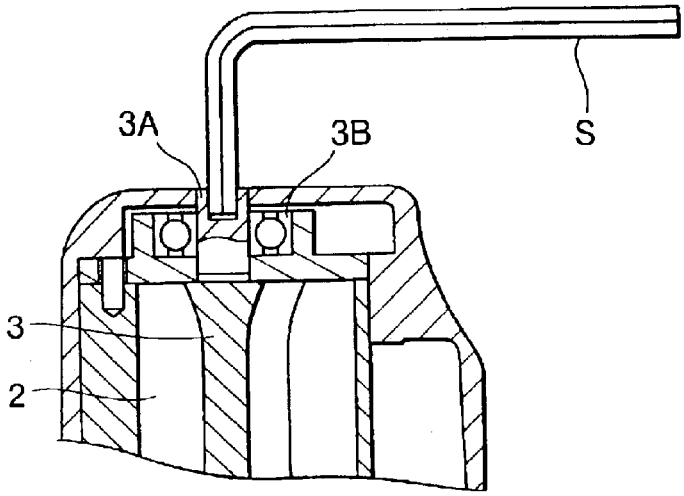
FIG. 4 is a cross-sectional view showing an essential portion of the first embodiment for description of exchange of a drive bit.
Figure 4:
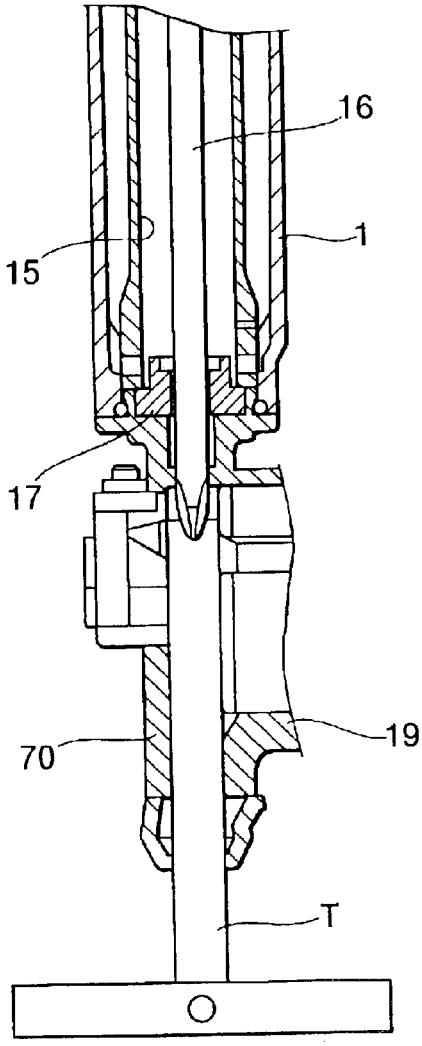

The rotor 3 has a rotor shaft with an axially protruded part rotatably supported by a bearing 3B. The axially protruded part serves as a tool mounting portion 3A. That is, the tool mounting portion 3A is rotatably supported by the casing 1 through a bearing 3B. The tool mounting portion 3A is formed with a hexagonal hole 3*a* exposed to outside of the casing 1. As shown in FIG. 4, the hexagonal hole 3*a* is adapted for insertion by a hexagonal spanner S.

In the pneumatically operated screw driver according to the first embodiment, the right-handed or clockwise rotation is performed by the drive bit 16 to fasten the screw 18 into the workpiece W. Because the female thread hole 28*a* and the male thread 16A are engaged with each other by right-handed threads, the threading engagement between the screw hole 28*a* and the male screw 16A will not loosen during screw tightening operations.

Next, operation for replacing the drive bit 16 will be described with reference to FIG. 4. First, an attachment/detachment tool T is inserted through the lower end of the nose 17 and engaged with the tip of the drive bit 16. Then, the hexagonal spanner S is fitted into the hole of the tool engaging portion 3A provided at the upper end of the rotor 3 of the pneumatic motor 2. Then, either the hexagonal spanner S or the attachment/detachment tool T is rotated leftward (counterclockwise) while the other is maintained fixed in place. Alternately, both the hexagonal spanner S and the attachment/detachment tool T could be rotated leftward (counterclockwise) at the same time while rotation angle is different from each other. The leftward or counterclockwise rotation loosens engagement between the female thread hole 28*a* and the male thread 16A. The leftward rotation is continued until the drive bit 16 separates from the piston 13. The attachment/detachment tool T is then pulled out from the nose 70 and the drive bit 16 is removed.

Next, a new drive bit 16 is inserted through the lower-side hole of the nose 70. The attachment/detachment tool T is engaged with the tip of the new drive bit 16 and the male thread 16A and the female thread hole 28*a* are brought into threading engagement by rotating the hexagonal spanner S, or the attachment/detachment tool T, or both rightward (clockwise). Once the threading engagement between the female thread hole 28*a* and the male thread 16A is sufficiently tight, the attachment/detachment tool T is removed. This completes operations for replacing the drive bit 16.

This type of pneumatically operated screw driver screws the screw 18 into the workpiece W by lowering movement and rotation of the drive bit 16. Therefore, the tip of the drive bit 16 will be frequently damaged by friction from direct contact with the screw 18. The drive bit 16 needs to be replaced each time its tip is damaged. Because the pneumatically operated screw driver according to the present embodiment enables replacing the drive bit 16 without removing the nose 70 from the casing 1, replacing the drive bit 16 is much easier than with the conventional configuration. Because there is no need to remove the nose 70, dirt and other foreign matter will not enter into the area near the cylinder 15 when the drive bit 16 is being replaced. Therefore, breakdowns caused by such foreign matter can be reduced. Even if the tip of the drive bit 16 partially fuses to the cross-shaped opening in the head of the screw 18 during screwing operations, the drive bit connecting portion 28A will maintain the drive bit 16 securely connected to the piston 13 during clockwise rotation of the drive piston 13, because the female thread hole 28*a* formed in the piston 13 and the male thread 16A formed on the drive bit 16 are fixed together by right-handed threading engagement.

Next, a pneumatically operated screw driver according to a second embodiment of the present invention will be described with reference to FIGS. 5 and 6. In the second embodiment, a drive bit 116 is divided into an upper section 117 and a lower section 118. The upper section 117 is provided integrally with the piston 13 (FIG. 1), and the lower section 118 is provided with a cruciform head 118B for engagement with a cruciform grooves of the screw 18.

Figure 5:
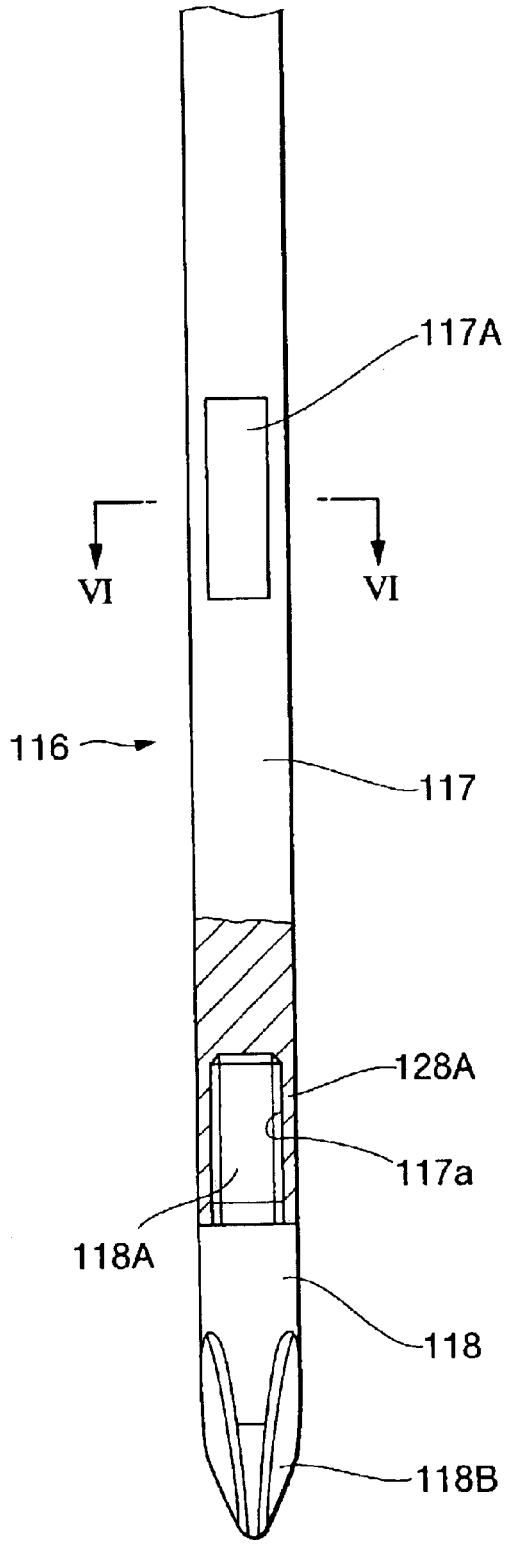
FIG. 5 is a partial view showing a drive bit used in a pneumatically operated screw driver according to a second embodiment of the present invention.
Figure 6:
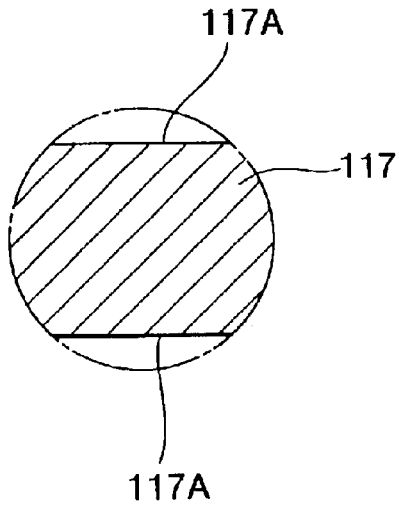
FIG. 6 is a cross-sectional view taken along line VI—VI of FIG. 5.

A right-handed female thread hole 117*a* is formed in a lower portion of the upper section 117 and the right-handed male thread 118A threadingly engageable with the female thread hole 117*a* is formed in an upper portion of the lower section 118 as shown in FIG. 5. The threading engagement area corresponds to a drive bit connecting portion 128A. Upon threading engagement of the male thread 118A with the female thread hole 117*a*, the lower section 118 is linearly aligned with the upper section 117. Alternatively, a male thread could be formed in the lower portion of the upper section 117 and the female thread whole could be formed in the upper portion of the lower section 118. A tool access portion 117A is provided in the upper section 117 for engagement with a spanner or other tool. That is, the tool access portion 117A is provided by cutting away diametrically opposite sides of a part of the upper section 117 so as to provide a flat parallel surfaces.

In the second embodiment, the rotation slide member 7, the piston 13, and the upper section 117 configure the rotation movement member. During operation of the pneumatically operated screw driver, rotation of the pneumatic motor 2 rotates the rotation movement member and the lower section 118 rightward (clockwise) while the piston 13 lowers down by pressure applied thereto. Therefore, the upper section 117 and the lower section 118 will not disengage from each other.

For replacing the lower section 118 by a new lower section, the drive bit 116 is moved to its lowermost position as shown for example in FIG. 2 by shaking the entire device downwardly. The nose 70 (FIG. 2) is provided with a feed gate (not shown) through which the bundle of screws is fed toward a shooting position in alignment with the drive bit 116. The feed gate is positioned at a position F in FIG. 2. The feed gate can be opened. When the drive bit 116 is moved to its lowermost position, the access portion 117A is positioned outside the casing 1 and in the nose 70. Therefore, the access portion 117A can be easily accessed by a tool after opening the feed gate.

Similar to the first embodiment, the cruciform end of the lower section 118 is engaged with the attachment/detachment tool T (FIG. 4) while the drive bit 116 is moved to its lowermost position. Then, a nipper nips the access portion 117A to hold the upper section 117 in a given place. Then, the attachment/detachment tool T is rotated in the counterclockwise direction while stabling the casing 1 for preventing the rotation of the upper section 117. As a result, the lower section 118 can be removed from the upper section 117. Other components, operations, and effects of the second embodiment are substantially the same as those in the first embodiment, so further description will be omitted.

Figure 7:
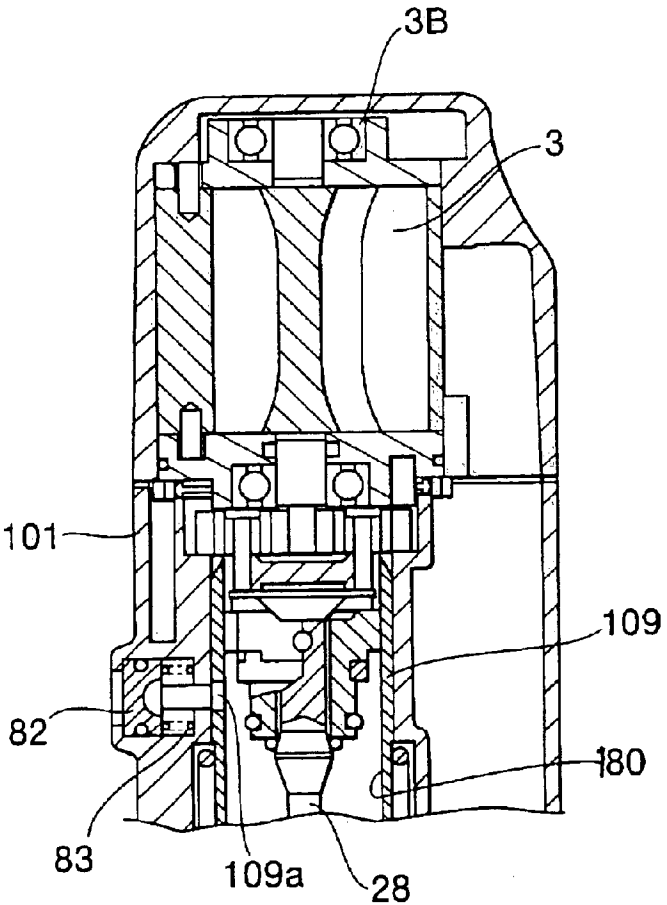
FIG. 7 is a cross-sectional view showing a pneumatically operated screw driver according to a third embodiment of the present invention.
Figure 9:
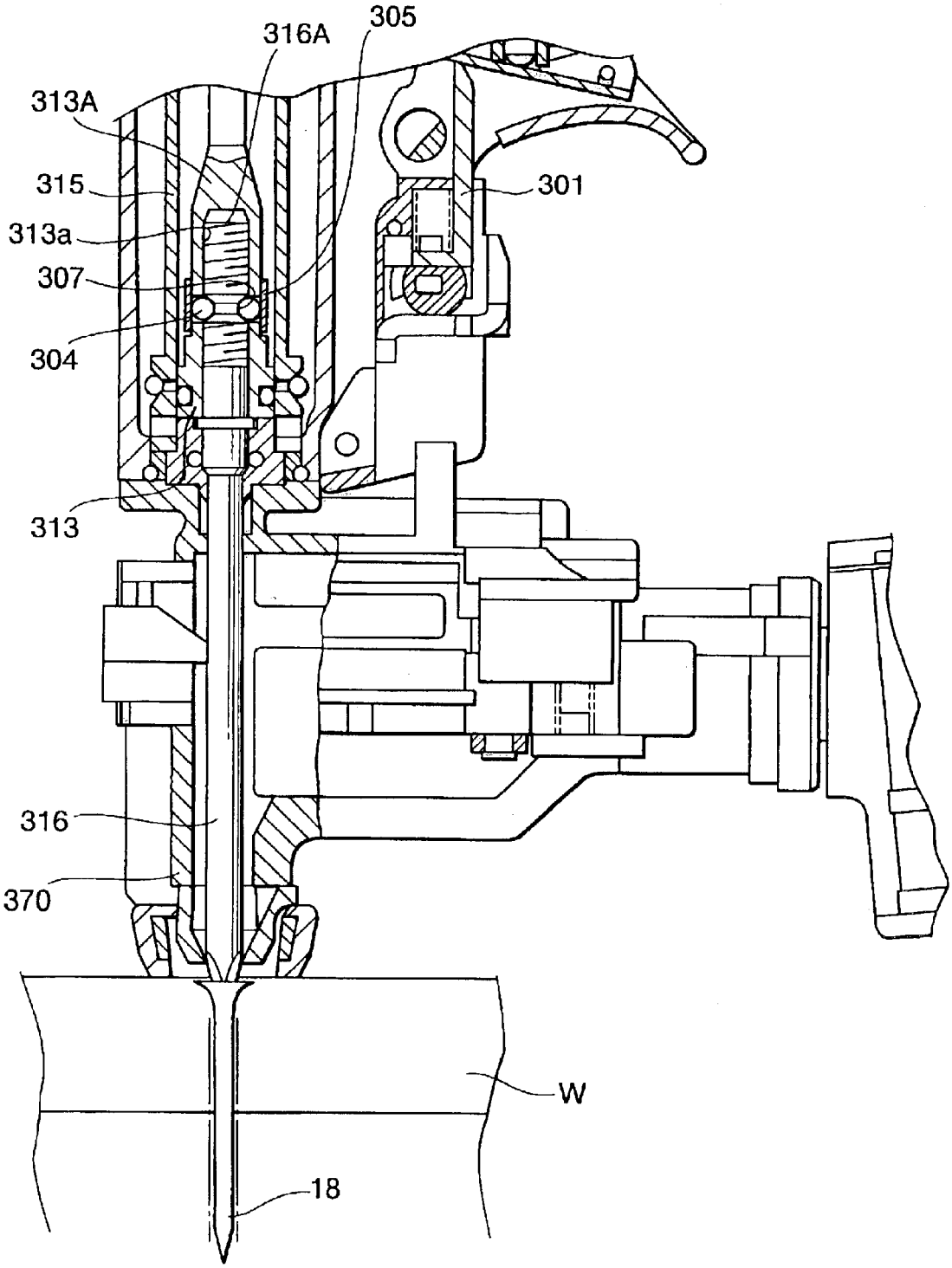
FIG.9 PRIOR ART
FIG. 9 is a cross-sectional view showing a conventional pneumatically operated screw driver.

Next, a pneumatically operated screw driver according to a third embodiment of the present invention will be described with reference to FIG. 7. In the third embodiment, the threading connection between the drive bit 16 and the piston 13 with the female thread hole 28*a* and the male thread 16A is the same as that in the first embodiment. However, in the third embodiment, a rotation shaft of the rotor 3 is covered with the casing 101, so that the tool engagement portion 3A in the first embodiment is not provided. According to the third embodiment, a radial hole 109*a* is formed in a rotary member 109 of the rotation transmission portion 180. Also, a rotation stopping pin 82 is unremovably provided in the casing 101 at the position of the hole 109*a*. A head of the rotation stopping pin 82 is exposed so as to be operable from the outside of the casing 101 by an operator's finger. A spring 83 is provided that constantly urges the rotation stopping pin 82 radially outwardly, i.e., away from the hole 109*a*.

To replace the drive bit 16, first the attachment/detachment tool T (FIG. 4) is inserted through the nose 70 and engaged with the tip of the drive bit 16. Then, the user presses in the head of the rotation stopping pin 82 radially inwardly against the biasing force of the spring 83, for example using his finger. Next, the user rotates the attachment/detachment tool T until the rotation stopping pin 82 engages in the hole 109*a* in the rotary member 109, thus locking the rotary member 109, the rotation slide member 7, and the piston 13 in place so their rotation is prevented. In this condition, the user rotates the attachment/detachment tool T leftward (counterclockwise) to loosen the male thread 16A from the female thread hole 28*a* of the piston 13 until the drive bit 16 can be separated from the piston 13. Next, the attachment/detachment tool T and the old drive bit 16 are removed through the lower opening in the nose 70. After a new drive bit 16 and the attachment/detachment tool T are inserted through the lower opening in the nose 70 in this order, the attachment/detachment tool T is rotated rightward (clockwise) to firmly tighten the new drive bit 16 onto the piston 13 via the male thread 16A and the female thread hole 28*a*. Operations for replacing the drive bit 16 are complete once the attachment/detachment tool T is removed. Other configuration and operations of the third embodiment are the same as for the first embodiment so further description will be omitted.

The configuration of the third embodiment has the same effects as that of the first embodiment. In addition, because movement of the piston 13 can be stopped by operating the rotation stopping pin 82, the drive bit 16 can be removed and attached by merely rotating the attachment/detachment tool T. Operations for replacing the drive bit 16 are easier to perform than for the first embodiment because there is no need to provide a hexagonal spanner S.

Figure 8:
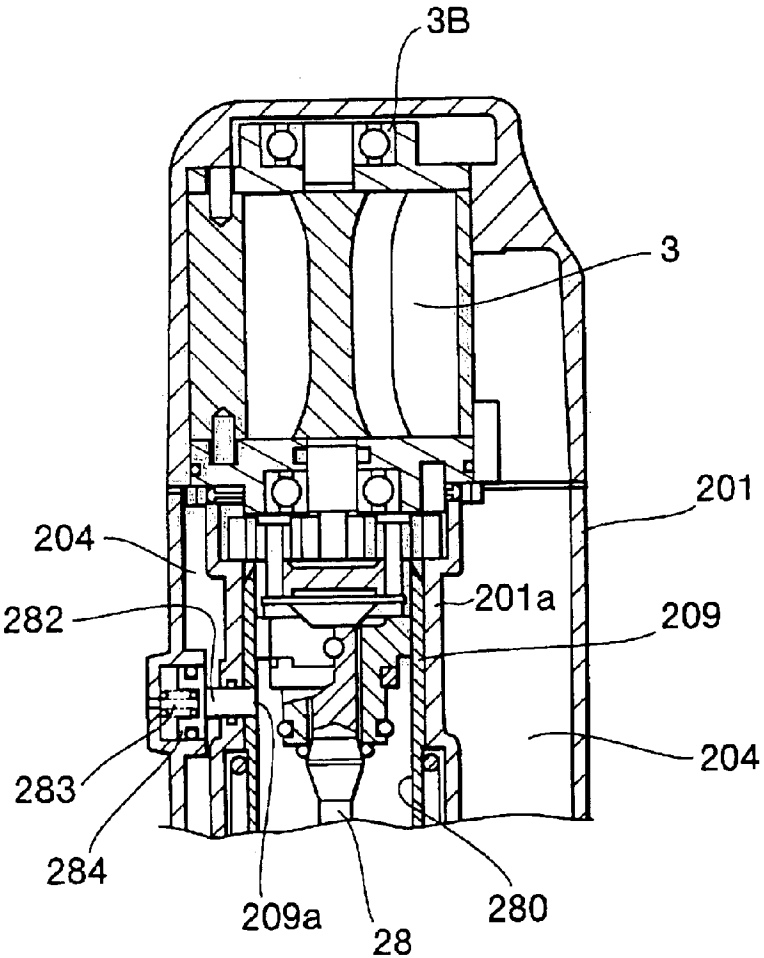
FIG. 8 is a cross-sectional view showing a pneumatically operated screw driver according to a fourth embodiment of the present invention.

Next, a pneumatically operated screw driver according to a fourth embodiment of the present invention will be described with reference to FIG. 8. Similar to the third embodiment, in the fourth embodiment, the threading connection between the drive bit 16 and the piston 13 with the female thread hole 28*a* and the male thread 16A is the same as that in the first embodiment. According to the fourth embodiment, a hole 209*a* is formed in a rotary member 209 of the rotation transmission portion 280. Also, a rotation stopping pin 282 is provided in an inner wall 201*a* at the position of the hole 209*a*. A spring 283 is provided that constantly urges the rotation stopping pin 282 toward the rotary member 209. A disc piston 284 is provided on a radially outer end of the rotation stopping pin 282. An inner side of the disc piston 284 nearest the rotation stopping pin 282 is constantly in fluid communication with an accumulator chamber 204. As long as compressed air is being supplied to the accumulator chamber 204, such as during screw tightening operations, the rotation stopping pin 282 moves against the force of the spring 283 in the direction to separate from the rotary member 209. In other words, while screw tightening operations are being performed, the rotation stopping pin 282 will separate from the rotary member 209 so that the rotation stopping pin 282 will not interfere with rotation of the rotary member 209.

For replacing the drive bit 16 with a new drive bit 16, first, the user disconnects the compressed-air intake port 27 from the compressor (not shown) so that compressed air in the accumulator chamber 204 exhausts to atmosphere. At this time, the compressed air pressing against the piston 284 also exhausts to atmosphere. As a result, the rotation stopping pin 282 moves into contact with the rotary member 209 under the biasing force of the spring 283.

Next, the user inserts the attachment/detachment tool T (FIG. 4) in through the lower hole of the nose 70 and engages the attachment/detachment tool T with the tip of the drive bit 16. Then, the user rotates the attachment/detachment tool T until the rotation stopping pin 282 engages with the hole 209*a* in the rotary member 209. As a result, the rotary member 209, the rotation slide member 7, and the piston 13 are locked in place and so cannot rotate.

Next, the user rotates the attachment/detachment tool T leftward (counterclockwise) to loosen the male thread 16A from the female thread hole 28*a* in the piston and separate the drive bit 16 from the piston 13. Then, the user removes the attachment/detachment tool T and the drive bit 16 from though the hole in the nose 70.

The user then inserts a new drive bit 16 and the attachment/detachment tool T through the hole in the nose 70. Once user engages the attachment/detachment tool T with the tip of the drive bit 16, the user rotates the attachment/detachment tool T to firmly tighten the male thread 16A into the female thread hole 28*a*. This completes operations for replacing the drive bit 16. Other configuration and operations of the fourth embodiment are the same as in the first embodiment so their description will be omitted.

The fourth embodiment achieves the following effects in addition to the effects of the first embodiment. Because the rotation stopping pin 282 is prevented from engaging with the piston 13 only by operation of compressed air, the rotation stopping pin 282 will automatically engage with and fix the piston 13 in place after the compressed-air intake port 27 is detached from the compressor and the compressed air is exhausted to atmosphere and after an angular rotation of the tool T.

While the invention has been described in detail with reference to specific embodiments thereof, it would be apparent to those skilled in the art that various changes and modifications may be made therein without departing from the spirit and scope of the invention.

What is claimed is:

1. A pneumatically operated screw driver that operates with a compressed air to drive screws into a workpiece, the screw driver comprising:

a casing;

an accumulator chamber portion in the casing for defining an accumulator chamber that accumulates the compressed air;

a pneumatic motor rotatable by the compressed air from the accumulator chamber in one direction only;

a rotation transmission portion including a rotary cylinder that transmits rotation of the pneumatic motor;

a rotator rotatable only in a right-hand direction by the rotation transmitted by the rotation transmission portion, the rotator comprising:

a rotation slide member supported in the rotary cylinder so as to rotate together with the rotation of the rotary cylinder and so as to be movable in an axial direction of the rotary cylinder; and a piston connected to the rotation slide member and rotatable together with the rotation of the rotation slide member and movable in the axial direction;

a drive bit connecting portion formed with one of a right-handed female threaded hole and a right-handed male threaded screw;

a main valve for controlling supply of the compressed air in the accumulator chamber to the pneumatic motor and the rotary cylinder;

an operation valve for controlling the main valve and accessible from an external position; and a drive bit formed at one end with one of the right-handed male thread screw and a female threaded hole and at the other end with an engagement tip engagable with the screws that are to be screwed into the workpiece, the drive bit being threadingly engaged with the drive bit connecting portion through threading engagement of the right-handed female threaded hole and the right-handed male threaded screw, the rotation of one of the pneumatic motor, the rotary cylinder and the rotator being regulatable during non-application of the compressed air into the pneumatic motor, while the engagement tip at the other end of the drive bit is engaged with a first tool.

2. The pneumatically operated screw driver as claimed in claim 1, wherein the drive bit connecting portion is provided at one end of the piston so that the one end of the drive bit is directly threadingly connected to the one end of the piston.

3. The pneumatically operated screw driver as claimed in claim 2, wherein the pneumatic motor has a rotation shaft having one end exposed to an atmosphere, the rotation shaft having an exposed end face formed with an engagement section engagable with a second tool so as to regulate rotation of the rotator through the pneumatic motor.

4. The pneumatically operated screw driver as claimed in claim 2, wherein the rotary member is formed with a radial hole; and the pneumatically operated screw driver further comprising a rotation preventive unit supported by the casing at a position in confrontation with the radial hole, the rotation preventive unit being selectively engageable with the radial hole for preventing the rotary cylinder from its free rotation about its axis to prevent free rotation of the rotator.

5. The pneumatically operated screw driver as claimed in claim 4, wherein the rotation preventive unit comprises:

a pin member supported by the casing and having a radially outer end provided with a head, and inner end engageable with the radial hole, the head being exposed to atmosphere for an access; and a biasing member disposed between the casing and the head for urging the pin member radially outwardly away from the radial hole.

6. The pneumatically operated screw driver as claimed in claim 4, wherein the accumulator chamber is provided at a space between the casing and the rotary cylinder, and the rotation preventive unit comprises:

a rotation stop pin having an outer end and an inner end portion engagable into the radial hole;

a disc piston connected to the outer end of the rotary stop pin, the disc piston being hermetically and movably supported by the casing and having an inner face facing the accumulator chamber, the compressed air in the accumulator chamber urging the disc piston radially outwardly to disengage the rotary stop pin from the radial hole; and a biasing member disposed between the disc piston and the casing for normally urging the rotation stop pin to engage the radial hole, the biasing member providing a biasing force smaller than a compressed air pressure in the accumulator chamber.

7. The pneumatically operated screw driver as claimed in claim 1, wherein the drive bit is integrally fixed to the piston, and wherein the drive bit is divided into a major section integrally fixed to the piston and a minor section threadingly engaged with and in line with the major section, so that the rotator further comprises the major section, the drive bit connecting portion being defined at one end of the major section.

8. The pneumatically operated screw driver as claimed in claim 7, wherein the one end of the major section is formed with one of a right-handed female threaded hole and a right-handed male threaded screw; and wherein the minor section has one end formed with one of the right-handed male thread screw and a female threaded hole and another end formed with the engagement tip engagable with the screws that are to be screwed into the workpiece, the one end of the major section being threadingly engaged with the one end of the minor section through threading engagement of the right-handed female threaded hole and the right-handed male threaded screw.

9. The pneumatically operated screw driver as claimed in claim 8, wherein the major section is formed with a nipped area exposed to an atmosphere upon lowermost movement of the drive bit, the nipped area being nipped by a second tool for regulating the free rotation of the major section.

* * * * *